US011999444B2

(12) United States Patent
Ohiso

(10) Patent No.: US 11,999,444 B2
(45) Date of Patent: Jun. 4, 2024

(54) PROPULSION DEVICE AND HYDROFOIL CRAFT PROVIDED WITH SAME

(71) Applicant: HONDA MOTOR CO., LTD., Tokyo (JP)

(72) Inventor: Keiichi Ohiso, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 339 days.

(21) Appl. No.: 17/584,846

(22) Filed: Jan. 26, 2022

(65) Prior Publication Data

US 2022/0242524 A1 Aug. 4, 2022

(30) Foreign Application Priority Data

Feb. 1, 2021 (JP) ..... 2021-014500

(51) Int. Cl.
*B63B 1/24* (2020.01)
*B63H 11/08* (2006.01)

(52) U.S. Cl.
CPC ..... *B63B 1/246* (2013.01); *B63H 11/08* (2013.01); *B63H 2011/081* (2013.01)

(58) Field of Classification Search
CPC .... B63B 1/00; B63B 1/16; B63B 1/24; B63B 1/242; B63B 1/246; B63B 1/248; B63B 1/26; B63B 1/28; B63B 1/285; B63B 1/286; B63B 1/30; B63H 11/00; B63H 11/02; B63H 11/04; B63H 11/08; B63H 2011/081
USPC .... 114/271, 274, 275, 278, 280; 440/38, 40, 440/42, 43
See application file for complete search history.

(56) References Cited

U.S. PATENT DOCUMENTS 6,167,829 B1 * 1/2001 Lang ..... B63B 1/38 114/61.12

FOREIGN PATENT DOCUMENTS

JP H061181 U 1/1994

* cited by examiner

*Primary Examiner* — Daniel V Venne
(74) *Attorney, Agent, or Firm* — Armstrong Teasdale LLP

(57) ABSTRACT

A propulsion device for a hydrofoil craft includes: a hydrofoil configured to be disposed in water; and a water jet thruster that is disposed in front of the hydrofoil and ejects a water flow rearward from an ejection port, wherein an upper surface of a rear portion of the hydrofoil is slanted downward toward rear, and the hydrofoil and the water jet thruster are configured such that at least part of the water flow passes above the rear portion of the hydrofoil.

6 Claims, 10 Drawing Sheets

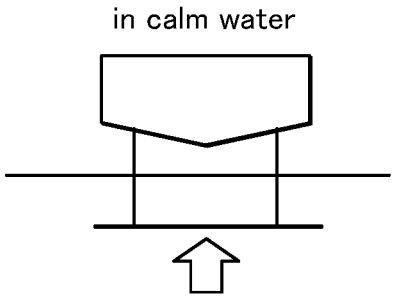
(A1)
Fig.9A1
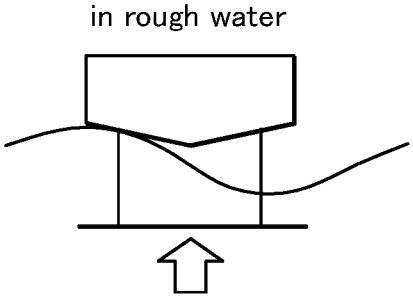
(A2)
Fig.9A2
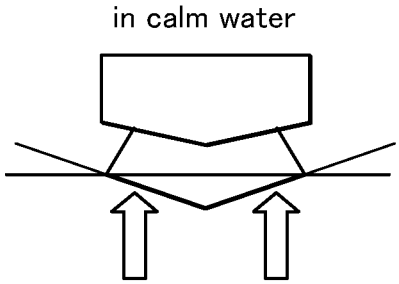
(B1)
Fig.9B1
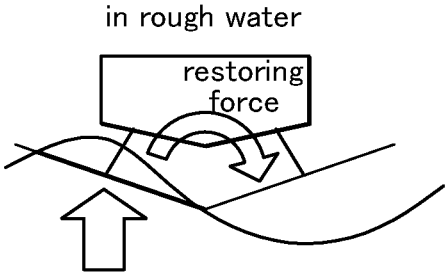
(B2)
Fig.9B2

PROPULSION DEVICE AND HYDROFOIL CRAFT PROVIDED WITH SAME

TECHNICAL FIELD

The present disclosure relates to a propulsion device for a hydrofoil craft and a hydrofoil craft provided with the propulsion device.

BACKGROUND ART

A hydrofoil craft has hydrofoils provided at positions lower than the body of the hull to reduce the water resistance generated when propelling, and travels by raising the hull above the water surface by the lift of the hydrofoils which increases as the hydrofoil craft gains speed. Such hydrofoil craft may be a fully-submerged hydrofoil craft whose hydrofoils are all below the water surface when the hydrofoil craft travels at a high speed or a surface-piercing hydrofoil craft whose hydrofoils partially rise above the water surface when the hydrofoil craft travels at high speed.

FIG. 9 is a diagram for explaining the characteristics of hydrofoil crafts, in which part (A1) shows a fully-submerged hydrofoil craft in calm water, part (A2) shows a fully-submerged hydrofoil craft in rough water, part (B1) shows a surface-piercing hydrofoil craft in calm water, and part (B2) shows a surface-piercing hydrofoil craft in rough water. As shown in part (A1) of FIG. 9, the fully-submerged hydrofoil craft is less subject to wave action in calm water and thus is comfortable to ride. On the other hand, as shown in part (A2) of FIG. 9, in rough water, the restoring force generated in the fully-submerged hydrofoil craft in response to tilt of the hull is small and thus the fully-submerged hydrofoil craft lacks stability of buoyancy. As shown in part (B2) of FIG. 9, in the surface-piercing hydrofoil craft, a relatively large restoring force is generated in response to tilt of the hull in rough water and therefore the stability of buoyancy is excellent. However, since the restoring force generated in response to the tilt of the hull cannot be controlled, the ride quality is relatively low in calm water shown in part (B1) of FIG. 9. Thus, in the hydrofoil craft, it is difficult to achieve both ride comfort and stability of buoyancy.

FIG. 10 shows a correlation between the travel speed and the hull resistance (or drag) in a conventional watercraft and in a hydrofoil craft. As shown in FIG. 10, the hull resistance of the hydrofoil craft is greater than the conventional displacement watercraft due to the resistance of the hydrofoils before take-off at which the hull separates from the water. Therefore, unless the hydrofoil craft travels at high speed and for a long time, the hull resistance reduction effect, which is an advantage of the hydrofoil craft, is not effectively demonstrated.

To improve the take-off performance and the ride quality during hullborne operation, there is proposed a fully-submerged hydrofoil craft having a pair of left and right assist foils provided in bilateral symmetry on an outer surface of a bottom portion of the hull (see JPH6-1181U). This hydrofoil craft is provided with a driving means for selectively driving the pair of assist foils between a stowed position where the assist foils are folded in toward the outer surface of the bottom portion and a use position where the assist foils are extended substantially horizontally as viewed from the front.

However, since the hydrofoil craft of JPH6-1181U needs to include the driving means for selectively driving the pair of left and right assist foils between the stowed and the use position, the structure thereof becomes complicated. Also, in the hydrofoil craft of JPH6-1181U, even though the position of the pair of left and right assist foils can be selectively switched, the lift generated by the assist foils depends on the travel speed of the hydrofoil craft, and thus, it is difficult to control the attitude of the hull by adjusting the generation of lift.

SUMMARY OF THE INVENTION

In view of such background, a first object of the present invention is to provide a propulsion device for a hydrofoil craft that is capable of improving the take-off performance without complicating the structure. Also, a second object of the present invention is to provide a hydrofoil craft that is simple in structure and can control the attitude of the hull as desired.

MEANS TO ACCOMPLISH THE TASK

To achieve the first object, one embodiment of the present invention provides a propulsion device (3) for a hydrofoil craft (1), comprising: a hydrofoil (5) configured to be disposed in water; and a water jet thruster (6) that is disposed in front of the hydrofoil and ejects a water flow rearward from an ejection port (10), wherein an upper surface (11) of a rear portion of the hydrofoil is slanted downward toward rear, and the hydrofoil and the water jet thruster are configured such that at least part of the water flow passes above the rear portion of the hydrofoil.

According to this configuration, since at least part of the water flow ejected from the water jet thruster passes above the hydrofoil, when the water flow is weak (when the velocity of the water flow relative to the hydrofoil is less than a prescribed value), the water flow is deflected downward along the upper surface of the hydrofoil due to the Coandă effect and the hydrofoil generates a lift. On the other hand, when the water flow is strong (the velocity of the water flow relative to the hydrofoil is greater than or equal to the prescribed value), the water flow passing above the hydrofoil separates at the rear portion of the hydrofoil and therefore generates substantially no lift. As a result, when the water jet thruster ejects the water flow at low speed, a large lift is generated, so that the take-off performance is improved. Note that as the velocity of the water flow ejected from the water jet thruster increases, the lift decreases due to the separation of the water flow, and this suppresses reduction in the thrust, whereby the hull resistance reduction effect is effectively demonstrated.

Preferably, a leading edge (13) of the hydrofoil is positioned lower than a center (17) of the ejection port.

According to this configuration, like an upper surface blowing (USB) type, more than half of the water flow flows rearward along the upper surface of the hydrofoil. Therefore, when the water flow is weak, more than half of the water flow flowing above the rear portion of the hydrofoil is deflected downward along the upper surface of the hydrofoil so that the lift of the hydrofoil increases.

Preferably, the leading edge of the hydrofoil is positioned lower than a lower edge (16) of the ejection port.

According to this configuration, the amount of water flow flowing above the hydrofoil is large and the lift generated when the water flow is deflected downward along the upper surface of the hydrofoil due to the Coandă effect becomes large. Therefore, the take-off performance is further improved.

Preferably, a leading edge (13) of the hydrofoil is positioned higher than a center (17) of the ejection port, and an intermediate portion of the hydrofoil in a fore and aft direction is provided with a slot (26) that permits passage of the water flow from under the hydrofoil to above the hydrofoil.

According to this configuration, like an externally blown flap (EBF), more than half of the water flow flows rearward under the hydrofoil, and at least part thereof passes through the slot and flows rearward above the rear portion of the hydrofoil. Therefore, when the water flow is weak, the water flow flowing above the rear portion of the hydrofoil is deflected downward along the upper surface of the hydrofoil, thereby causing the hydrofoil to generate a lift.

Preferably, the ejection port is laterally elongated in shape.

According to this configuration, the width of the water flow deflected downward along the upper surface of the hydrofoil due to the Coandă effect becomes larger so that a larger lift is generated. Therefore, the take-off performance is further improved.

Further, to achieve the aforementioned second object, one embodiment of the present invention provides a hydrofoil craft (1) comprising: at least three propulsion devices (3) including those disposed on a hull (2) at mutually different positions in a fore and aft direction and those disposed at mutually different positions in a lateral direction, each propulsion device having the above-described configuration; a pitch sensor (21) that detects pitching of the hull; a roll sensor (22) that detects rolling of the hull; and a control device (23) that controls attitude of the hull based on detection results of the pitch sensor and the roll sensor, wherein the control device controls the pitching of the hull by making thrusts produced by the water jet thrusters disposed at mutually different positions in the fore and aft direction different from each other, and controls the rolling of the hull by making thrusts produced by the water jet thrusters disposed at mutually different positions in the lateral direction different from each other.

According to this configuration, by controlling the thrusts produced by the water jet thrusters of the at least three propulsion devices with the control device, it is possible to control the attitude of the hull as desired. Also, since the multiple propulsion devices each have the aforementioned configuration and the control device controls the attitude of the hull by making the thrusts produced by the water jet thrusters of these propulsion devices different from one another, the structure is simple.

As described above, according to the present invention, a propulsion device for a hydrofoil craft that is capable of improving the take-off performance without complicating the structure can be provided. Also, according to the present invention, a hydrofoil craft that is simple in structure and can control the attitude of the hull as desired can be provided.

BRIEF DESCRIPTION OF THE DRAWINGS

FIG. 9A1 is a diagram showing a fully-submerged hydrofoil craft in calm water;

FIG. 9A2 is a diagram showing a fully-submerged hydrofoil craft in rough water;

FIG. 9B1 is a diagram showing a surface-piercing hydrofoil craft in calm water;

FIG. 9B2 is a diagram showing a surface-piercing hydrofoil craft in rough water.

DETAILED DESCRIPTION OF THE INVENTION

Figure 1:
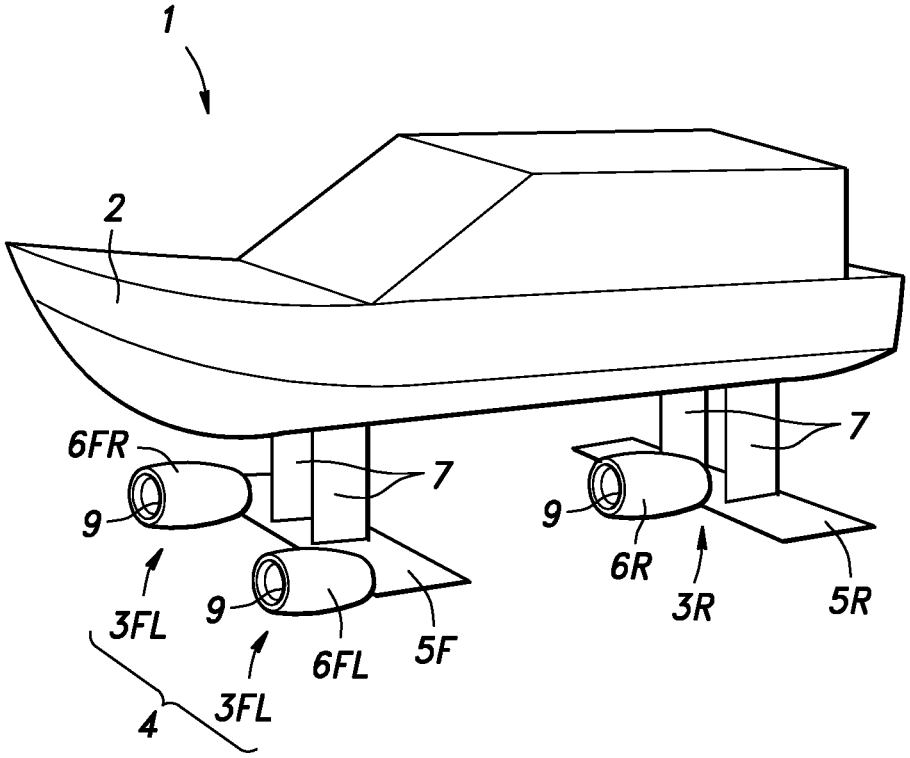
FIG. 1 is a perspective view of a hydrofoil craft according to a first embodiment of the present invention.

In the following, embodiments of the present invention will be described in detail with reference to the drawings. In the drawings, identical or similar devices or members will be denoted by same reference signs, with suffixes indicating their position, such as FL (front left), FR (front right), R (rear), etc. When the position is not distinguished, the suffixes may be omitted. Also, the suffixes FL (front left) and FR (front right) may be collectively written as F (front).

First Embodiment

First, with reference to FIGS. 1 to 6, a first embodiment of the present invention will be described. FIG. 1 is a perspective view of a hydrofoil craft 1 according to the first embodiment. As shown in FIG. 1, the hydrofoil craft 1 includes a hull 2 and multiple propulsion devices 3 attached to a lower portion of the hull 2. The hydrofoil craft 1 of the present embodiment has three propulsion devices 3 (3FL, 3FR, 3R). The two propulsion devices 3 (3FL, 3FR) disposed on the front side are configured to jointly form a propulsion unit 4 having a bilaterally symmetric unitary structure, which is attached to a front portion of the hull 2 in a bilaterally symmetric manner. The single propulsion device 3 (3R) disposed on the rear side is attached to a rear portion of the hull 2 centrally in the lateral direction.

The propulsion unit 4 is provided with a hydrofoil SF disposed substantially horizontally below the front portion of the hull 2, a front left water jet thruster 6FL disposed in front of a left side portion of the hydrofoil SF, and a front right water jet thruster 6FR disposed in front of a right side portion of the hydrofoil SF. The left half of the front hydrofoil SF and the front left water jet thruster 6FL constitute the front left propulsion device 3FL, and the right half of the front hydrofoil SF and the front right water jet thruster 6FR constitute the front right propulsion device 3FR. The rear propulsion device 3R is provided with a rear hydrofoil SR disposed substantially horizontally below the rear portion of the hull 2 and a rear water jet thruster 6R disposed in front of a lateral center of the rear hydrofoil SR.

Thus, the hydrofoil craft 1 is provided with the three propulsion devices 3 disposed on the hull 2 such that the propulsion devices 3 include those disposed at mutually different positions in the fore and aft direction (the pair of front propulsion devices 3FR, 3FL is disposed at a position different from the position of the rear propulsion device 3R in the fore and aft direction) and those disposed at mutually different positions in the lateral direction (the three propulsion devices 3FR, 3FL, and 3R are disposed at mutually different positions in the lateral direction). In the propulsion devices 3 of the present embodiment, the hydrofoils 5 are not provided with movable flaps. The thrust produced by each of the water jet thrusters 6 of these propulsion devices 3 is controlled by a control device 23, which will be described later. In another embodiment, the hydrofoils 5 of the propulsion devices 3 may be provided with movable flaps.

Each of the front and rear hydrofoils 5 is supported by left and right struts 7 that extend downward substantially vertically from a bottom portion of the hull 2. Each of the front left, front right, and rear propulsion devices 3 is supported on the corresponding hydrofoil 5 by an appropriate support member 8 (see FIG. 8). The propulsion devices 3 have a substantially same configuration though the hydrofoils 5 have different configurations. In the following, the configuration of the propulsion devices 3 will be described, with the suffixes regarding the position being omitted.

Figure 2:
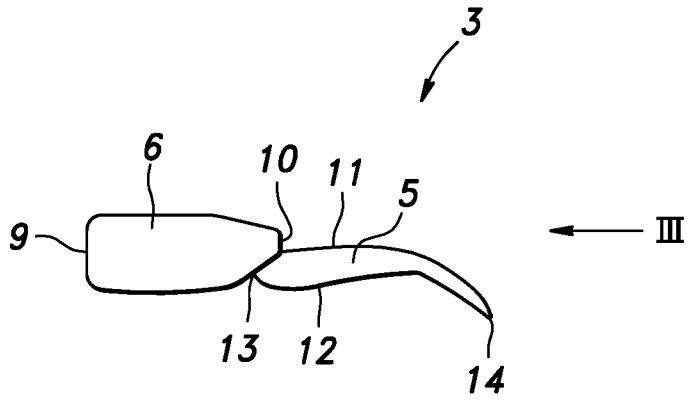
FIG. 2 is a side view of the propulsion device according to the first embodiment.
Figure 3:
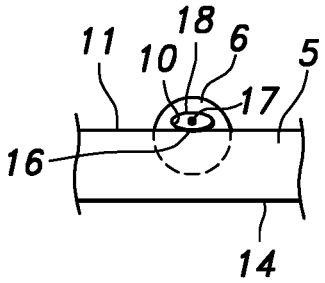
FIG. 3 is a rear view of the propulsion device according to the first embodiment.

FIG. 2 is a side view of the propulsion device 3 according to the first embodiment and FIG. 3 is a rear view (a view as seen along arrow III in FIG. 2) of the propulsion device 3 according to the first embodiment. As shown in FIGS. 2 and 3, the water jet thruster 6 is provided with a suction port 9 (FIG. 1) and an ejection port 10 (FIG. 3) and has an impeller (not shown in the drawings) rotatably supported therein. The ejection port 10 opens rearward at the rear end of the water jet thruster 6. With the impeller driven rotationally, the water jet thruster 6 takes in water from the suction port 9 and ejects a water flow rearward from the ejection port 10 thereby to produce a thrust.

The water jet thruster 6 of the present embodiment is substantially tubular in shape and the suction port 9 opens forward at the front end of the water jet thruster 6. As shown in FIG. 1, the suction port 9 has a circular shape. On the other hand, as shown in FIG. 3, the ejection port 10 is flat in shape (more specifically, has a laterally elongated shape having a horizontal dimension greater than a vertical dimension) and is formed in an upper portion of the water jet thruster 6. The ejection port 10 of the illustrated embodiment has an elliptic shape.

As shown in FIG. 2, the hydrofoil 5 has a flat cross-sectional shape having a larger dimension in the fore and aft direction than the thickness and is provided with an upper surface 11 and a lower surface 12. The upper surface 11 of the hydrofoil 5 is curved to be convex upward. In the present embodiment, the hydrofoil 5 has a thickness that gradually decreases from the leading edge (front edge) 13 to the trailing edge (rear edge) 14, and the lower surface 12 of the hydrofoil 5 is curved to be convex upward similarly to the upper surface 11. In another embodiment, the lower surface 12 of the hydrofoil 5 may extend substantially straight from the leading edge 13 to the trailing edge 14. The upper surface 11 of the hydrofoil 5 extends substantially horizontally in the fore and aft direction at the front portion thereof and the rear portion of the upper surface 11 is slanted downward toward the rear (more specifically, toward the trailing edge 14 of the hydrofoil 5).

The water jet thruster 6 is disposed such that the ejection port 10 is positioned behind and above the leading edge 13 of the hydrofoil 5. More specifically, the water jet thruster 6 is disposed such that the leading edge 13 of the hydrofoil 5 is positioned forward of the ejection port 10 and lower than the lower edge 16 of the ejection port 10. Thereby, the entirety of the water flow ejected rearward from the ejection port 10 of the water jet thruster 6 passes above the hydrofoil 5.

In another embodiment, an arrangement may be made such that the leading edge 13 of the hydrofoil 5 is positioned higher than the lower edge 16 of the ejection port 10 and lower than the center 17 of the ejection port 10. Here, the center 17 of the ejection port 10 means the geometric center of the ejection port 10 as seen from rear. In this arrangement, more than half of the water flow ejected rearward from the ejection port 10 of the water jet thruster 6 passes above the hydrofoil 5.

Alternatively, an arrangement may be made such that the leading edge 13 of the hydrofoil 5 is higher than the center 17 of the ejection port 10 and lower than the upper edge 18 of the ejection port 10. In this case, at least part of the water flow ejected rearward from the ejection port 10 of the water jet thruster 6 passes above the hydrofoil 5.

Figure 4A:
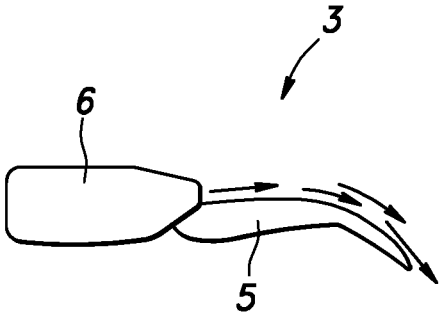
FIG. 4A is a diagram explaining the operation and effect of the propulsion device during low rotation speed.
Figure 4B:
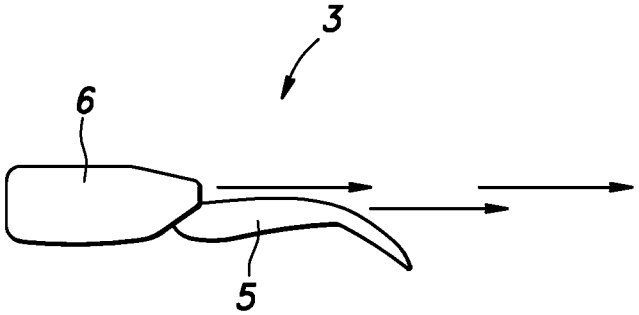
FIG. 4B is a diagram explaining the operation and effect of the propulsion device during high rotation speed.

FIGS. 4A and 4B are diagrams for explaining the operation and effect of the propulsion device 3. In FIG. 4A, the water flow during low rotation speed is represented by arrows and in FIG. 4B, the water flow during high rotation speed is represented by arrows. Here, "during low rotation speed" means when the impeller of the water jet thruster 6 is rotated at low speed and the water flow is weak (when the velocity of the water flow relative to the hydrofoils 5 is less than a prescribed value) and "during high rotation speed" means when the impeller of the water jet thruster 6 is rotated at high speed and the water flow is strong (when the velocity of the water flow relative to the hydrofoils 5 is greater than or equal to the prescribed value).

During low rotation speed of the propulsion device 3, the water flow ejected from the water jet thruster 6 to above the hydrofoil 5 is weak, and the water flow is deflected downward along the upper surface 11 of the hydrofoil 5 due to the Coandă effect, as shown in FIG. 4A. As a result, the hydrofoil 5 generates a lift. The lift generated by the hydrofoil 5 increases as the velocity of the water flow relative to the hydrofoil 5 becomes higher so long as separation of the water flow from the upper surface of the hydrofoil 5 does not occur. On the other hand, during high rotation speed of the propulsion device 3, the water flow ejected from the water jet thruster 6 to above the hydrofoil 5 is strong and the water flow passing above the hydrofoil 5 separates at the rear portion of the hydrofoil 5, as shown in FIG. 4B, whereby substantially no lift is generated.

Figure 5:
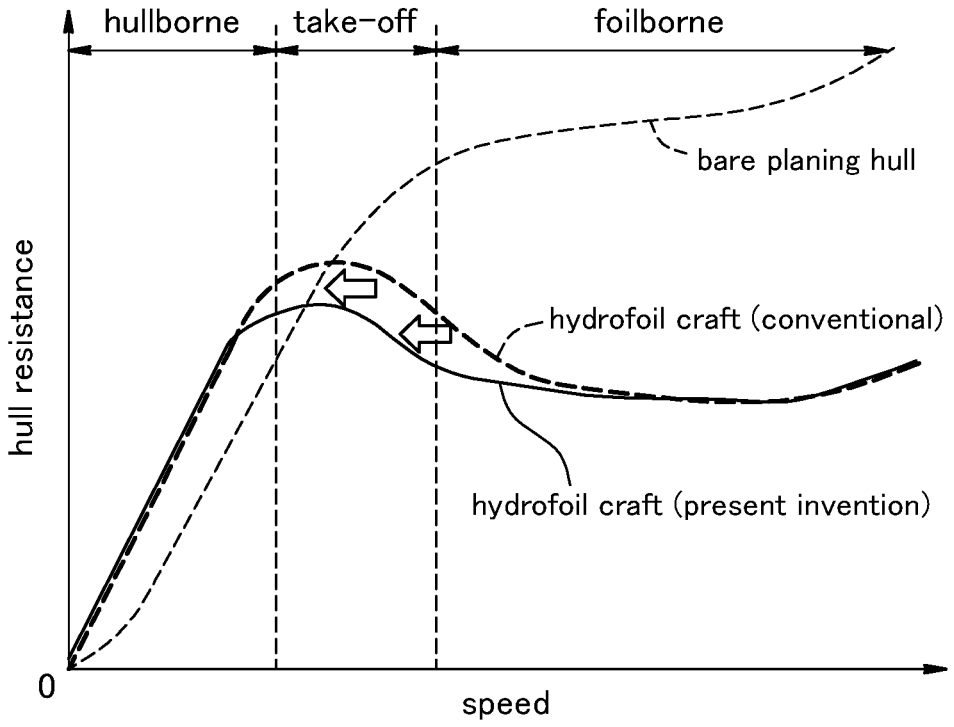
FIG. 5 is a diagram showing correlation between the travel speed and the hull resistance in the hydrofoil craft according to the first embodiment.

As a result, when the water jet thruster 6 ejects the water flow at low speed, a large lift is generated, whereby the take-off performance is improved. FIG. 5 is a correlation diagram showing correlation between the travel speed and the hull resistance (drag) in the hydrofoil craft 1 according to the embodiment. As shown in FIG. 5, in the hydrofoil craft 1 according to the embodiment, the hydrofoil 5 generates a large lift sufficient to raise the hull 2 above water at a lower speed compared to the conventional hydrofoil craft. Thus, the foilborne range is expanded to the low travel speed side, whereby the hull resistance becomes smaller compared to the conventional hydrofoil craft. Note that as the velocity of the water flow ejected from the water jet thruster 6 increases beyond a certain velocity, the lift decreases due to the separation of the water flow, and this suppresses reduction in the thrust, whereby the hull resistance reduction effect is effectively demonstrated.

In the present embodiment, as shown in FIGS. 2 and 3, the leading edge 13 of the hydrofoil 5 is positioned lower than the center 17 of the ejection port 10. Therefore, like an upper surface blowing (USB) type, more than half of the water flow flows rearward along the upper surface 11 of the hydrofoil 5. Thereby, when the water flow is weak, more than half of the water flow flowing above the rear portion of the hydrofoil is deflected downward along the upper surface 11 of the hydrofoil 5 and the lift of the hydrofoil 5 increases compared to the case where the leading edge 13 of the hydrofoil 5 is positioned higher than the center 17 of the ejection port 10.

Also, in the present embodiment, the leading edge 13 of the hydrofoil 5 is positioned lower than the lower edge 16 of the ejection port 10, as described above. Accordingly, the amount of water flow flowing above the hydrofoil 5 is large and the lift generated when the water flow is deflected downward along the upper surface 11 of the hydrofoil 5 due to the Coandă effect becomes large. Therefore, the take-off performance of the hydrofoil craft 1 is further improved.

Furthermore, in the present embodiment, the ejection port 10 is laterally elongated in shape, as described above. Accordingly, the width of the water flow deflected downward along the upper surface 11 of the hydrofoil 5 due to the Coandă effect becomes larger so that a larger lift is generated. Therefore, the take-off performance of the hydrofoil craft 1 is further improved.

Figure 6:
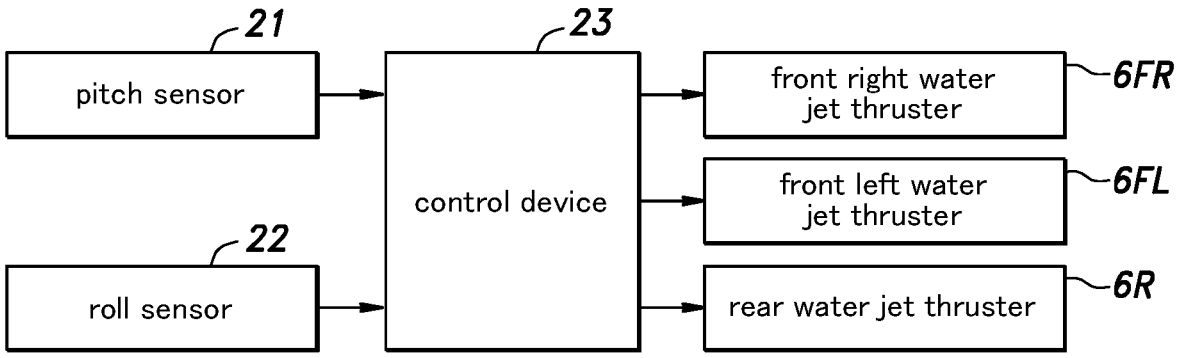
FIG. 6 is a functional block diagram of the hydrofoil craft according to the first embodiment.

FIG. 6 is a functional block diagram of the hydrofoil craft 1 according to the embodiment. As shown in FIG. 6, the hydrofoil craft 1 includes a pitch sensor 21 that detects pitching of the hull 2, a roll sensor 22 that detects rolling of the hull 2, and a control device 23 that controls the attitude of the hull 2 based on the detection results of the pitch sensor 21 and the roll sensor 22.

The control device 23 is an electronic control unit (ECU) constituted of a CPU, a ROM, a RAM, etc. The CPU reads out a program and executes computational processing along the program so that the control device 23 controls the attitude of the hull 2. The control device 23 may be constituted as one piece of hardware or may be constituted of a unit including multiple pieces of hardware. The control device 23 controls the attitude of the hull 2 by controlling the velocity of the water flow ejected from each water jet thruster 6, namely, by controlling the thrust produced by each water jet thruster 6, as described in detail below.

The control device 23 controls the pitching of the hull 2 by making the thrust produced by the pair of front (left and right) water jet thrusters 6F and the thrust produced by the rear water jet thruster 6R different from each other within a range less than the aforementioned prescribed value. Here, the pair of front water jet thrusters 6F and the rear water jet thruster 6R are disposed at mutually different positions in the fore and aft direction. Specifically, when the hull 2 is tilted forward, the control device 23 increases the thrust produced by the pair of front water jet thrusters 6F to enhance the lift on the front side of the hull 2. When the hull 2 is tilted rearward, the control device 23 increases the thrust produced by the rear water jet thruster 6R to enhance the lift on the rear side of the hull 2. In a case where the control device 23 increases one of the thrust produced by the pair of front water jet thrusters 6F and the thrust produced by the rear water jet thruster 6R, the control device 23 may reduce the other of the thrust produced by the pair of front water jet thrusters 6F and the thrust produced by the rear water jet thruster 6R so that the total thrust does not change.

Also, the control device 23 controls the rolling of the hull 2 by making the thrust produced by the front left water jet thruster 6FL and the thrust produced by the front right water jet thruster 6FR, which are disposed at different positions in the lateral direction, different from each other. Specifically, when the hull 2 is tilted to the right, the control device 23 increases the thrust produced by the front right water jet thruster 6FR to enhance the lift on the right side of the hull 2. When the hull 2 is tilted to the left, the control device 23 increases the thrust produced by the front left water jet thruster 6FL to enhance the lift on the left side of the hull 2. When the control device 23 increases the thrust produced by one of the front left and front right water jet thrusters 6FL and 6FR, the control device 23 may reduce the thrust produced by the other of the front left and front right water jet thrusters 6FL and 6FR so that the total thrust does not change.

Figure 7A:
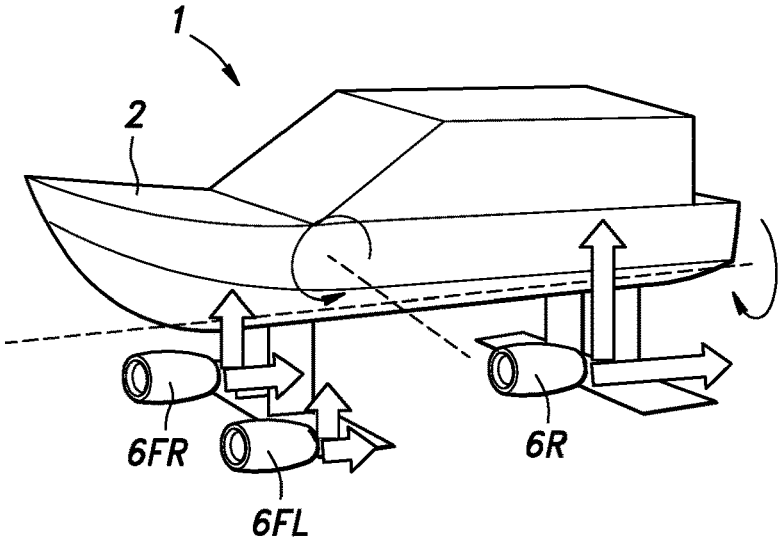
FIG. 7A is a diagram explaining attitude control of the hull during pitch and roll control.
Figure 7B:
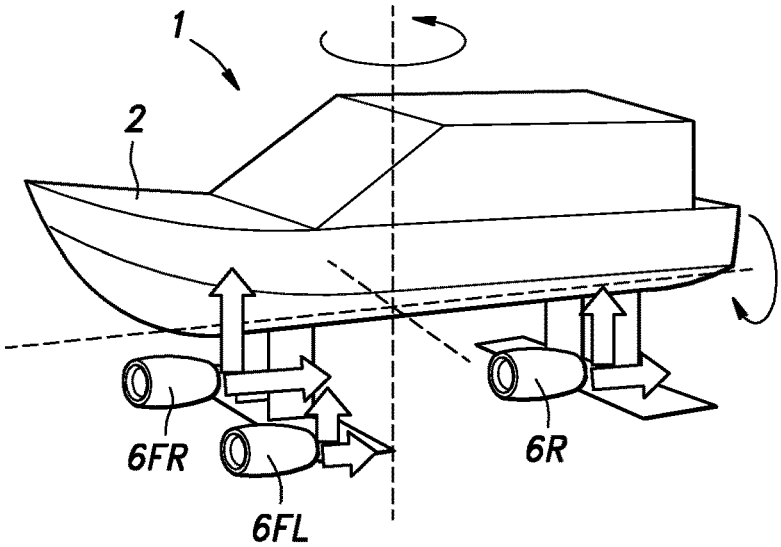
FIG. 7B is a diagram explaining attitude control of the hull during roll and yaw control.
Figure 7C:
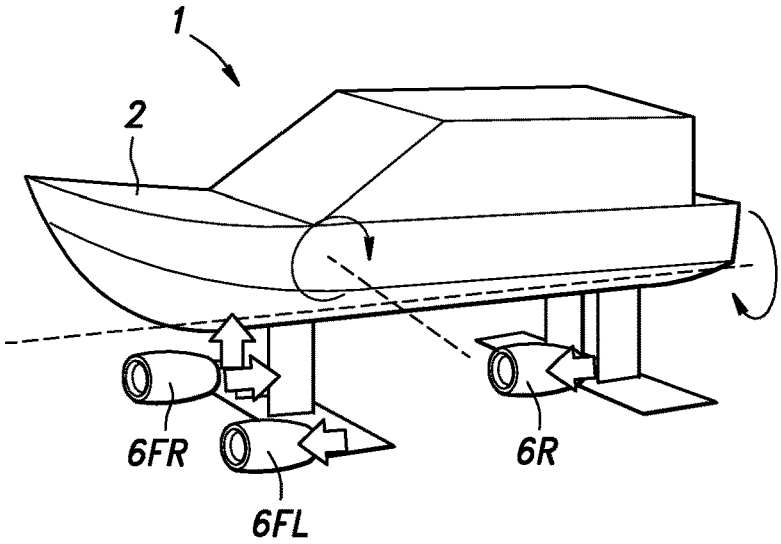
FIG. 7C is a diagram explaining attitude control of the hull during mooring.

FIGS. 7A to 7C are diagrams for explaining the attitude control of the hull 2 by the control device 23 during pitch and roll control, during roll and yaw control, and during mooring, respectively.

In the example of FIG. 7A, the control device 23 reduces the thrust produced by the front water jet thrusters 6F and increases the thrust produced by the rear water jet thruster 6R during foilborne operation. Also, the control device 23 reduces the thrust produced by the front left water jet thruster 6FL and increases the thrust produced by the front right water jet thruster 6FR. As a result, the lift on the rear side of the hull 2 and the lift on the right side of the hull 2 increase, so that the pitch of the hull 2 changes in the forward direction and the roll of the hull 2 changes in the left direction.

In the example of FIG. 7B, the control device 23 increases the thrust produced by the front right water jet thruster 6FR and reduces the thrust produced by the front left water jet thruster 6FL during foilborne operation. Thereby, the lift on the right side of the hull 2 increases so that the roll of the hull 2 changes in the left direction and the yaw of the hull 2 changes in the left direction.

In the example of FIG. 7C, the control device 23 increases the thrust produced by the front right water jet thruster 6FR in the forward direction and increases the thrust produced by the front left water jet thruster 6FL and the thrust produced by the rear water jet thruster 6R in the backward direction during mooring. The total of the thrust in the forward direction and the thrust in the backward direction is zero. Thereby, while the hull 2 does not move, the increase in the lift on the right side of the hull 2 causes the pitch of the hull 2 to change in the rearward direction and the roll of the hull 2 to change in the left direction.

As described above, in the hydrofoil craft 1 of the present embodiment, the control device 23 can control the attitude of the hull 2 as desired by controlling the thrusts of the water jet thrusters 6. Also, since the multiple propulsion devices 3 each have the aforementioned configuration and the control device 23 controls the attitude of the hull 2 by making the thrusts of these water jet thrusters 6 of these propulsion devices 3 different from one another, the structure is simple.

Second Embodiment

Figure 8:
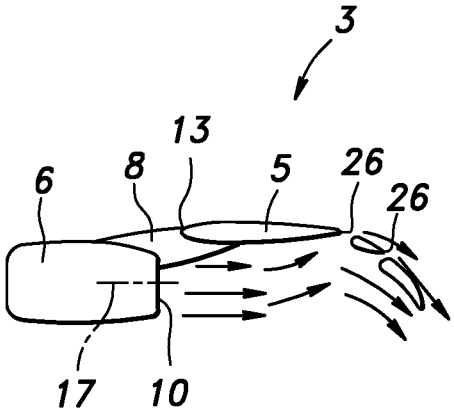
FIG. 8 is a side view of a propulsion device according to a second embodiment of the present invention.
Figure 10:
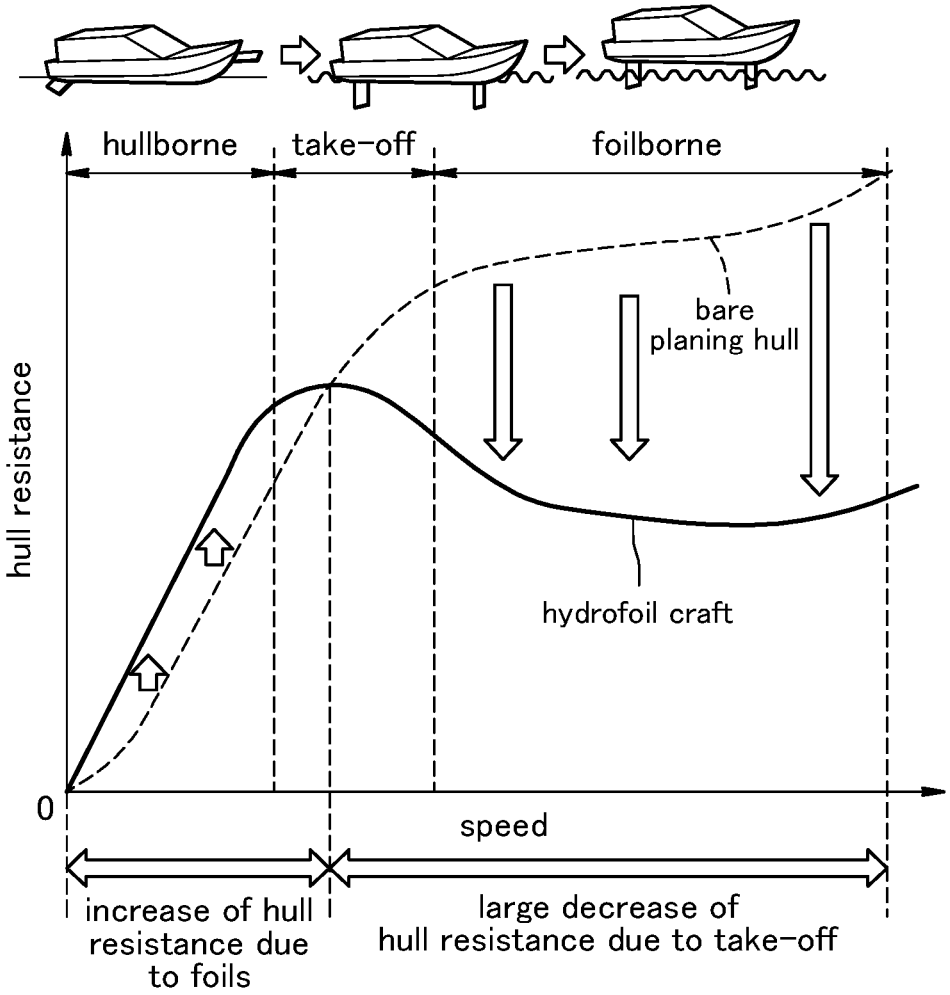
FIG. 10 is a diagram showing correlation between the travel speed and the hull resistance in a conventional watercraft and in a hydrofoil craft.

Next, with reference to FIG. 8, a second embodiment of the present invention will be described. Note that the elements having the same or similar structure or function as in the first embodiment are denoted by same reference signs and redundant explanation will be omitted.

In this embodiment, the configuration of the propulsion device 3 differs from the first embodiment. In the propulsion device 3 of this embodiment, the leading edge 13 of the hydrofoil 5 is positioned higher than the center 17 of the ejection port 10 of the water jet thruster 6. More specifically, the water jet thruster 6 is disposed such that the leading edge 13 of the hydrofoil 5 is positioned behind the ejection port 10 and higher than the upper end of the ejection port 10. Accordingly, like an externally blown flap (EBF), most of the water flow flows rearward under the hydrofoil 5.

An intermediate portion of the hydrofoil 5 in the fore and aft direction is provided with slots 26 for permitting passage of the water flow from under the hydrofoil 5 to above the hydrofoil 5. In the present embodiment, two slots 26 are provided at mutually different positions in the fore and aft direction. Owing to the provision of the slots 26 in the hydrofoil 5, at least part of of the water flow flowing under the hydrofoil 5 passes through the slots 26 to flow rearward above the rear portion of the hydrofoil 5. Therefore, when the water flow is weak, the water flow flowing above the rear portion of the hydrofoil 5 is deflected downward along the upper surface 11 of the hydrofoil 5, thereby causing the hydrofoil 5 to generate a lift.

On the other hand, when the water flow is strong, the lift of the hydrofoil 5 increases as the water flow that flows under the hydrofoil 5 becomes strong, but the water flow that flows above the hydrofoil 5 separates at the rear portion of the hydrofoil 5. Therefore, when the water flow becomes strong, the increase of the lift of the hydrofoil 5 is deterred by the water flow that flows to above the hydrofoils 5. Preferably, the slots 26 should be configured such that the stronger the water flow becomes, a higher proportion of the water flow flows above the hydrofoil 5.

Concrete embodiments of the present invention have been described in the foregoing, but the present invention is not limited to the above embodiments and may be modified or altered in various ways. For example, in the above embodiments, the hydrofoil craft 1 is exemplarily provided with three propulsion devices 3 but the hydrofoil craft 1 may be provided with four or more propulsion devices 3. Besides, the concrete structure, arrangement, number, angle, etc. of each member or part may be appropriately changed within the scope of the present invention. Also, not all of the components shown in the foregoing embodiments are necessarily indispensable and they may be selectively adopted as appropriate.

The invention claimed is:

1. A propulsion device for a hydrofoil craft, comprising:

a hydrofoil configured to be disposed in water; and a water jet thruster that is disposed in front of the hydrofoil and ejects a water flow rearward from an ejection port, wherein an upper surface of a rear portion of the hydrofoil is slanted downward towards a rear, and the hydrofoil and the water jet thruster are configured such that at least part of the water flow passes above the rear portion of the hydrofoil.

2. The propulsion device according to claim 1, wherein a leading edge of the hydrofoil is positioned lower than a center of the ejection port.

3. The propulsion device according to claim 2, wherein the leading edge of the hydrofoil is positioned lower than a lower edge of the ejection port.

4. The propulsion device according to claim 1, wherein a leading edge of the hydrofoil is positioned higher than a center of the ejection port, and an intermediate portion of the hydrofoil in a fore and aft direction is provided with a slot that permits passage of the water flow from under the hydrofoil to above the hydrofoil.

5. The propulsion device according to claim 1, wherein the ejection port is laterally elongated in shape.

6. A hydrofoil craft comprising:

at least three propulsion devices including those disposed on a hull at mutually different positions in a fore and aft direction and those disposed at mutually different positions in a lateral direction, each propulsion device consisting of the propulsion device according to claim 1;

a pitch sensor that detects pitching of the hull;

a roll sensor that detects rolling of the hull; and a control device that controls attitude of the hull based on detection results of the pitch sensor and the roll sensor, wherein the control device controls the pitching of the hull by making thrusts produced by the water jet thrusters disposed at mutually different positions in the fore and aft direction different from each other, and controls the rolling of the hull by making thrusts produced by the water jet thrusters disposed at mutually different positions in the lateral direction different from each other.

* * * * *